US008103188B2

(12) United States Patent
Murao

(10) Patent No.: US 8,103,188 B2
(45) Date of Patent: Jan. 24, 2012

(54) IMAGE FORMING APPARATUS

(75) Inventor: Hidetoshi Murao, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 352 days.

(21) Appl. No.: 12/388,673

(22) Filed: Feb. 19, 2009

(65) Prior Publication Data

US 2009/0214252 A1 Aug. 27, 2009

Related U.S. Application Data

(60) Provisional application No. 61/030,915, filed on Feb. 22, 2008.

(51) Int. Cl.
*G03G 15/08* (2006.01)

(52) U.S. Cl. ..... 399/121; 399/302; 399/317; 399/346

(58) Field of Classification Search ..... 399/101, 399/121, 297, 298, 302, 308, 313, 317, 346, 399/350; 184/14, 17, 99
See application file for complete search history.

(56) References Cited

U.S. PATENT DOCUMENTS

| | | | | |
|---|---|---|---|---|
| 2003/0235439 | A1* | 12/2003 | Nishida et al. | 399/297 |
| 2007/0172273 | A1* | 7/2007 | Harada et al. | 399/346 |
| 2008/0069614 | A1* | 3/2008 | Shintani et al. | 399/346 |
| 2008/0298864 | A1 | 12/2008 | Murao | |
| 2009/0067897 | A1 | 3/2009 | Murao | |

* cited by examiner

*Primary Examiner* — David P Porta
*Assistant Examiner* — Benjamin Schmitt
(74) *Attorney, Agent, or Firm* — Patterson & Sheridan, LLP

(57) ABSTRACT

An image forming apparatus includes a secondary transfer roller that is supported by a secondary-transfer-unit supporting unit and transfers a toner image onto a recording medium, a lubricant applying brush that comes into contact with the secondary transfer roller and applies a lubricant to the secondary transfer roller, a lubricant-applying-brush housing unit that houses the lubricant applying brush, a solid lubricant that is housed in the lubricant-applying-brush housing unit and supplies the lubricant to the lubricant applying brush, a lubricant holding member that elastically holds the solid lubricant, a driving gear that transmits rotational force from the outside to the lubricant applying brush, and a lubricant unit that supports at least the lubricant applying brush, the lubricant-applying-brush housing unit, the solid lubricant, the lubricant holding member, and the driving gear in an integral state and is formed to be detachably attachable to the secondary-transfer-unit supporting unit.

20 Claims, 4 Drawing Sheets

IMAGE FORMING APPARATUS

CROSS-REFERENCE TO RELATED APPLICATION

This application is based upon and claims the benefit of U.S. Provisional Application 61/030,915, filed Feb. 22, 2008.

TECHNICAL FIELD

The present invention relates to an image forming apparatus in which, in a secondary transfer unit having a mechanism for bringing a secondary transfer roller into contact with and separating the secondary transfer roller from an image bearing member, a lubricant unit including a lubricant applying brush, a lubricant assembly, and a driving gear is incorporated as a replacement part.

BACKGROUND

An image forming apparatus includes an image transfer unit that transfers a reversal image based on a scanned document image onto an image bearing member as a toner image and a secondary transfer unit that comes into contact with the image bearing member and transfers the toner image onto a recording medium.

The secondary transfer unit includes a contact and separation mechanism for bringing a secondary transfer roller into contact with the image bearing member when the toner image is transferred onto a sheet and separating the secondary transfer roller from the image bearing member when the toner image is not transferred onto the sheet.

There is known a secondary transfer roller contact and separation driving apparatus in which, in a secondary transfer unit having a mechanism for bringing a secondary transfer roller into contact with and separating the secondary transfer roller from an image bearing member, the number of components of a mechanical unit configuring a mechanism for performing contact and separation operations is not increased and a device such as an electromagnetic clutch that requires electric control is not used (see JP-A-2007-264546).

On the other hand, there is known an image forming apparatus mounted with a mechanism for bringing a cleaning blade into contact with a secondary transfer roller and cleaning the secondary transfer roller in order to scrape off a toner on the secondary transfer roller. Further, there is known a mechanism for applying a lubricant to the surface of a secondary transfer roller via a fur brush (a lubricant applying brush) in order to extend the durable life of the secondary transfer roller and prevent the cleaning blade from curling up. Solid zinc stearate is used as the lubricant. The zinc stearate is mounted on a holding member and pressed to the fur brush side by a spring. The holding member is formed of a member having high rigidity such as a sheet metal and is integrated with the zinc stearate to configure a lubricant assembly.

When the fur brush and the lubricant assembly are individually replaced as replacement parts, if a fingertip of an operator touches a bristle portion of the fur brush, stain, deformation, and the like of the fur brush are likely to occur. Therefore, handling during replacement and transportation is difficult. Further, since the lubricant is a fragile material, the lubricant tends to be broken (fractured or cracked) and, for example, has to be integrated with a sheet metal to be reinforced.

SUMMARY

According to an aspect of the present invention, there is provided an image forming apparatus including: an image transfer unit that transfers a reversal image based on a scanned document image onto an image bearing member as a toner image; a secondary-transfer-unit supporting unit; a secondary transfer roller that is supported by the secondary-transfer-unit supporting unit and comes into contact with the image bearing member and transfers the toner image onto a recording medium; a secondary-transfer-roller housing unit that houses the secondary transfer roller; a lubricant applying brush that comes into contact with the secondary transfer roller and applies a lubricant to the secondary transfer roller; a lubricant-applying-brush housing unit that houses the lubricant applying brush; a solid lubricant that is housed in the lubricant-applying-brush housing unit and supplies the lubricant to the lubricant applying brush; a lubricant holding member that elastically holds the solid lubricant; a driving gear that transmits rotational force from the outside to the lubricant applying brush; and a lubricant unit that supports at least the lubricant applying brush, the lubricant-applying-brush housing unit, the solid lubricant, the lubricant holding member, and the driving gear in an integral state and is formed to be detachably attachable to the secondary-transfer-unit supporting unit.

DETAILED DESCRIPTION

Figure 1:
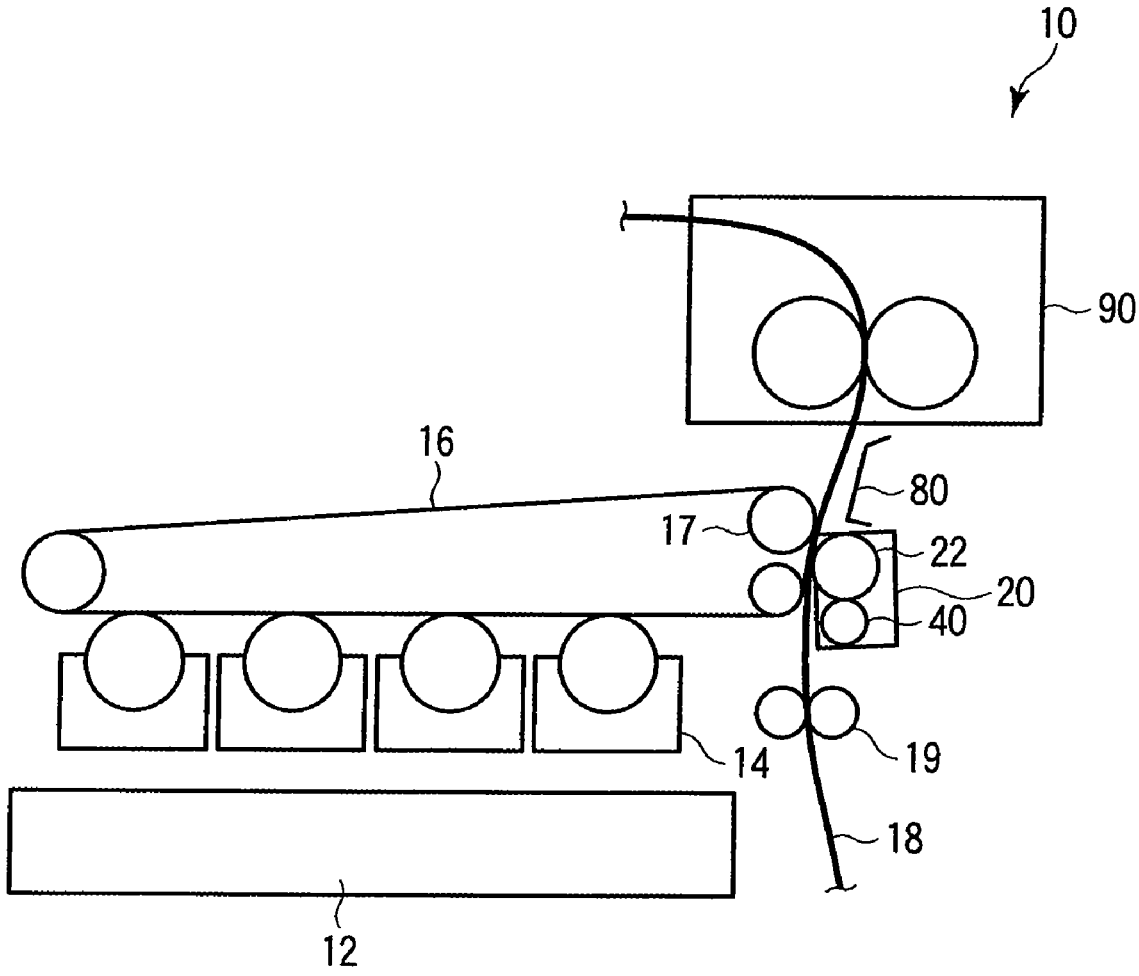
FIG. 1 is a schematic diagram of an image forming unit of an image forming apparatus according to a first embodiment of the present invention.
Figure 2:
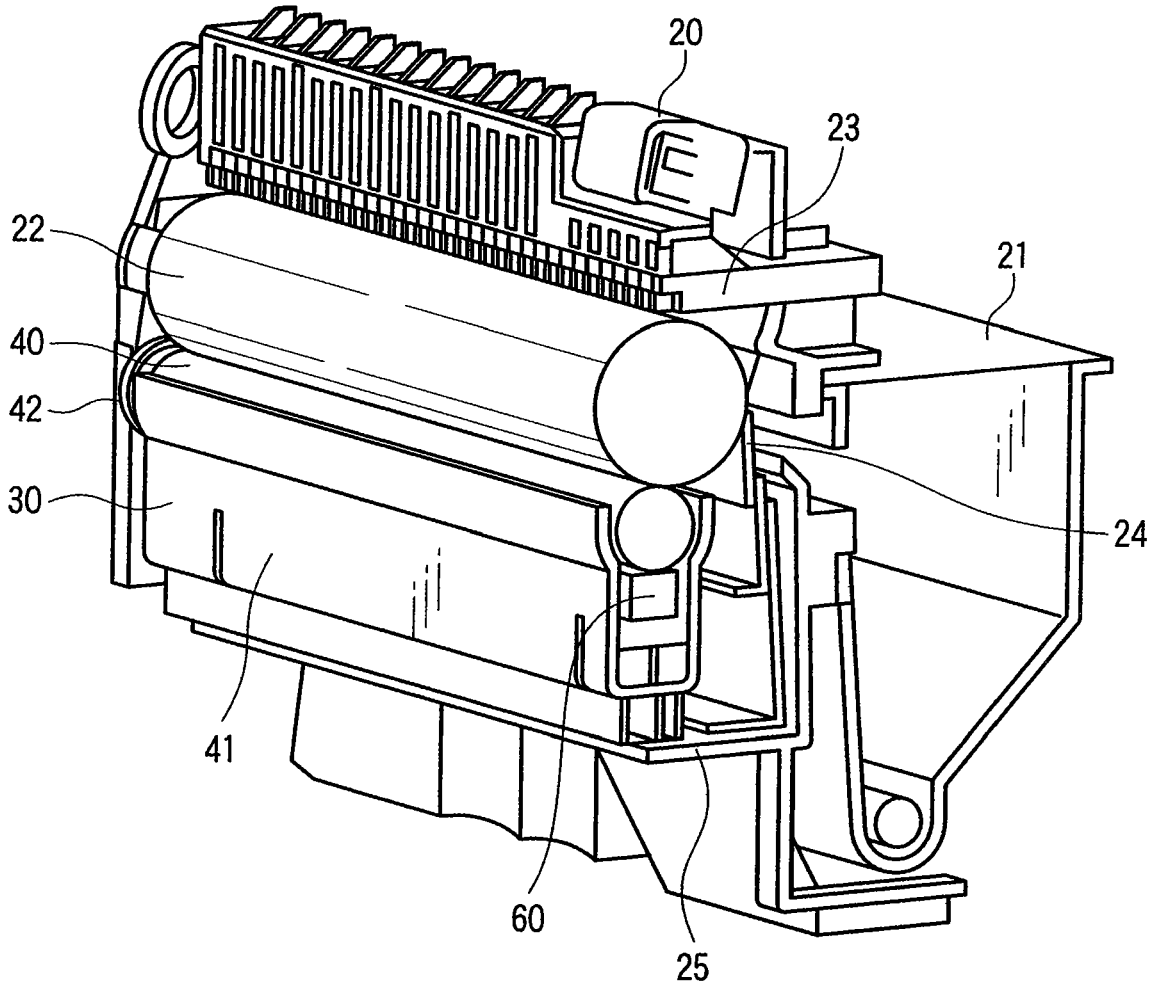
FIG. 2 is a perspective view of a configuration of a secondary transfer unit incorporated in the image forming unit.
Figure 3:
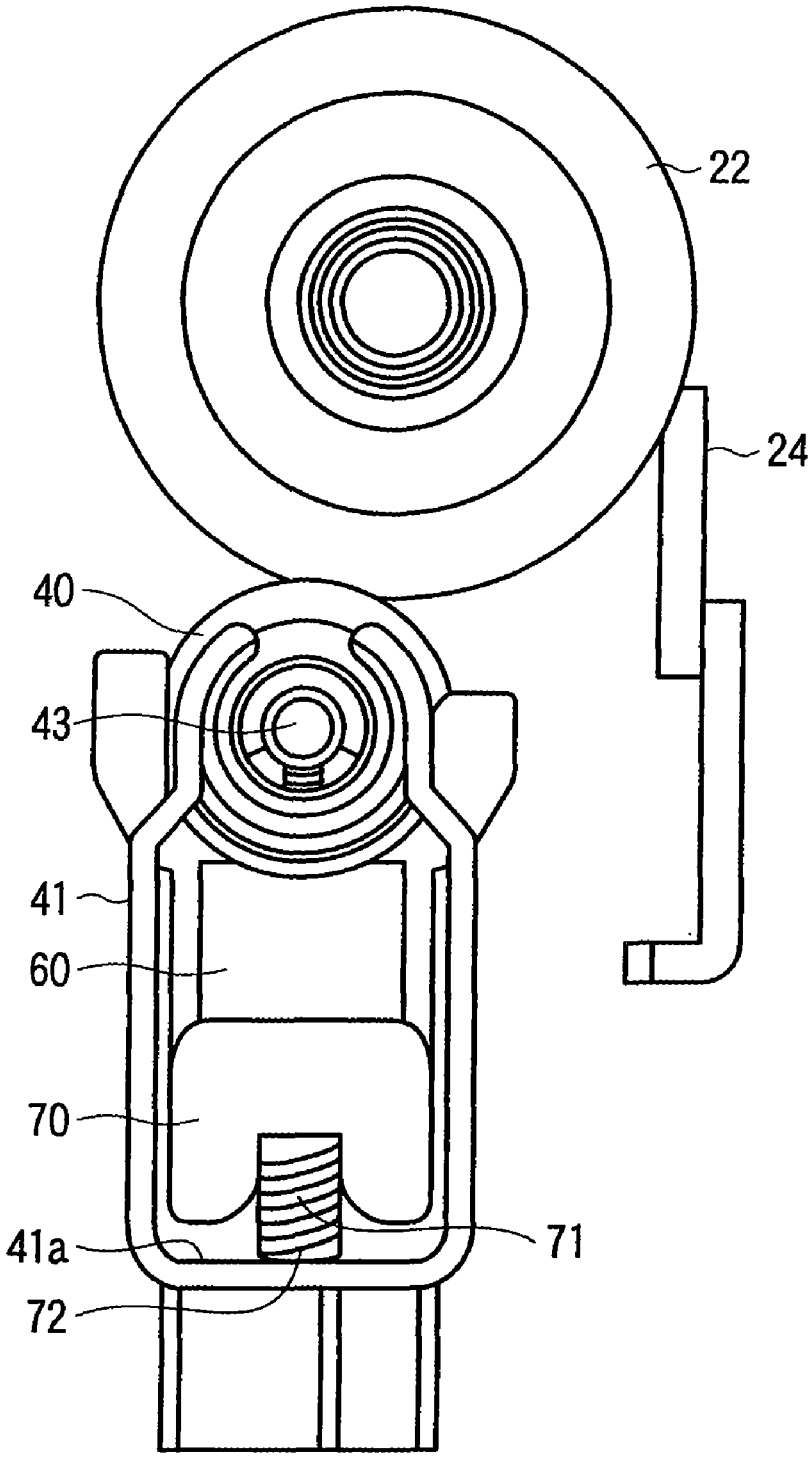
FIG. 3 is a side view of a main part of the secondary transfer unit.
Figure 4:
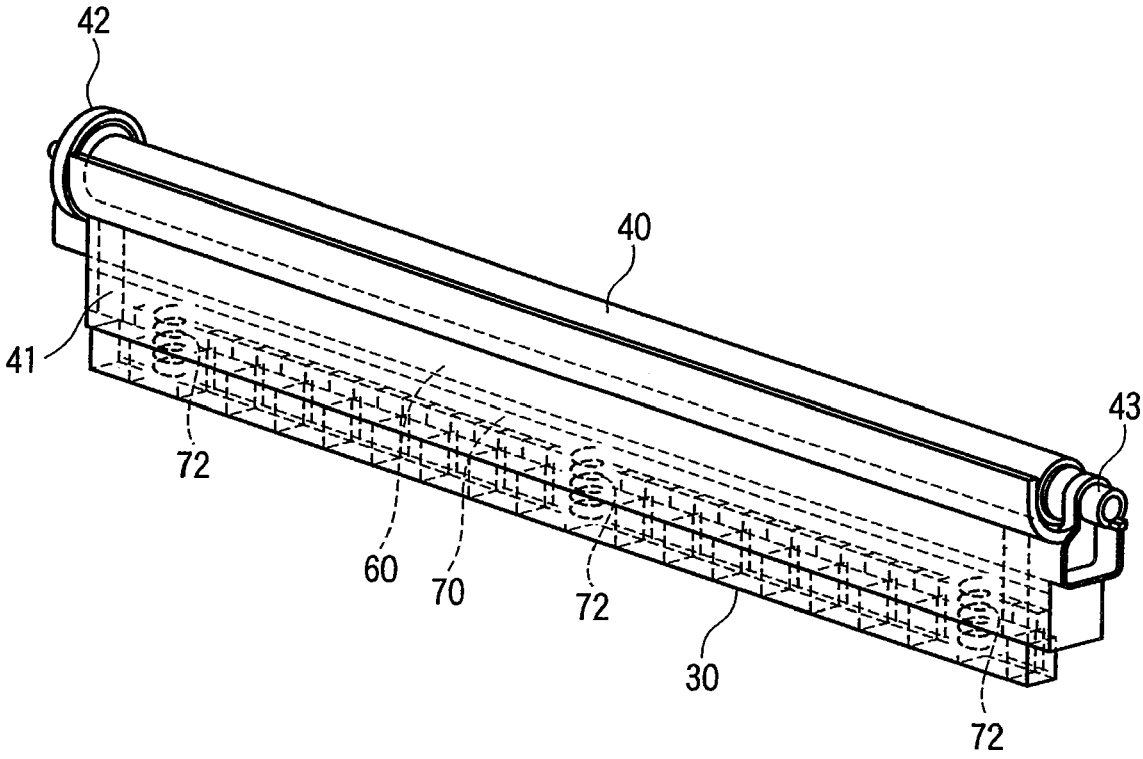
FIG. 4 is a perspective view of a lubricant unit incorporated in the secondary transfer unit.

FIG. 1 is a schematic diagram of an image forming unit 10 of an image forming apparatus according to a first embodiment of the present invention. FIG. 2 is a perspective view of a configuration of a secondary transfer unit 20. FIG. 3 is a side view of a main part of the secondary transfer unit 20. FIG. 4 is a perspective view of a lubricant unit 30.

As shown in FIG. 1, the image forming unit 10 includes a laser unit 12, developing devices 14, a transfer belt (an image bearing member) 16, a counter roller 17, a sheet conveying path 18, registration rollers 19, a secondary transfer unit 20, a conveyance guide 80, and a fixing device 90.

A laser unit 12 performs exposure using a laser beam optically modulated according to an image signal of an original document scanned by a not-shown scanner unit or an image signal input from an external apparatus and forms electrostatic latent images on the developing devices 14. The developing devices 14 reversely develop the electrostatic latent images and transfer toner images onto the transfer belt 16.

The sheet conveying path 18 is a conveying path for a sheet (a recording medium) fed from a not-shown sheet feeding unit. The registration rollers 19 correct a tilt of the sheet right before an image is transferred thereon. A secondary transfer roller 22 is arranged downstream of the registration rollers 19 to be opposed to the counter roller 17 and capable of coming into contact with the transfer belt 16. When the sheet passes between the transfer belt 16 and the secondary transfer roller 22, the toner images are collectively transferred onto the sheet. The conveyance guide 80 guides the sheet conveyed out from the secondary transfer roller 22 to the fixing device 90.

The fixing device 90 fixes the image transferred by the secondary transfer roller 22 on the sheet.

Reference numeral 20 in FIG. 2 denotes the secondary transfer unit. The secondary transfer unit 20 includes a secondary-transfer-unit supporting unit 21. The secondary-transfer-unit supporting unit 21 includes a secondary transfer roller 22 that comes into contact with an image bearing member and transfers a toner image onto a sheet and a secondary-transfer-roller housing unit 23 that houses the secondary transfer roller 22. The secondary-transfer-unit supporting unit 21 has a function of bringing the secondary transfer roller 22 into contact with and separating the secondary transfer roller 22 from the transfer belt 16. A cleaning blade 24 that scrapes off a residual toner adhering to the secondary transfer roller 22 is set in contact with the secondary transfer roller 22. A bracket 25 for detachably attaching a lubricant unit 30 is formed in the secondary-transfer-unit supporting unit 21.

In the lubricant unit 30, a fur brush 40, a lubricant case 41, a driving gear 42, a solid lubricant 60, a holding member 70, and a pressing spring 72 that presses the holding member 70 to the secondary transfer roller 22 side are integrally formed.

As shown in FIGS. 2 and 3, the fur brush 40 and the lubricant case (a lubricant holding member) 41 that is pressed against the fur brush 40 and supplies the lubricant (zinc stearate) 60 to the fur brush 40 are provided below the secondary transfer roller 22. The lubricant 60 is applied for the purpose of taking measures against curl-up of the cleaning blade 24 and extending the durable life of the secondary transfer roller 22.

A driving gear 42 is attached to a rotating shaft of the fur brush 40. The rotating shaft is supported by a shaft supporting bush 43. The driving gear 42 has a function of transmitting rotational force from the outside to the fur brush 40.

The solid lubricant 60 obtained by solidifying zinc stearate and the holding member 70 made of a resin material are housed in the lubricant case 41. The solid lubricant 60 is joined and integrated with the holding member 70 by a double-face tape or the like. A projection-like boss 71 is provided below a bottom surface of the holding member 70.

The holding member 70 is elastically attached to a bottom surface 41*a* of the lubricant case 41 via the pressing spring 72 arranged over a circumferential surface of the boss 71. The boss 71 has a function of preventing buckling of the pressing spring 72.

On the other hand, when replacement time comes after the use for several months, an operator performs replacement work as explained below.

The operator removes the lubricant unit 30 from the secondary-transfer-unit supporting unit 21. Then, the operator attaches a new lubricant unit 30 to the secondary-transfer-unit supporting unit 21.

According to the embodiment explained above, in replacing the fur brush 40 or the solid lubricant 60 because of exhaustion of the durable life, the operator replaces the lubricant unit 30 to simultaneously replace the fur brush 40 and the solid lubricant 60. Consequently, the fur brush 40 is not independently replaced and it is possible to minimize the likelihood that a fingertip of the operator touches the fur brush 40 and the solid lubricant 60. Therefore, stain, deformation, and the like can be prevented and handling during replacement and transportation is facilitated. Similarly, since the solid lubricant 60 is not independently replaced and can be prevented from being broken, a member having physical properties close to those of the solid lubricant 60 such as a resin material can be selected as the holding member 70 serving as a reinforcing member. Therefore, it is possible to adjust coefficients of thermal expansion and the like of the solid lubricant 60 and the holding member 70 to be the same.

Further, the solid lubricant 60 as a unit is held between two elastic materials, i.e., the fur brush 40 and the pressing spring 72. Therefore, it is possible to reduce, with a cushion effect, the risk of breakage (fracture or crack) during transportation.

Moreover, since the lubricant unit 30 is supplied as a unit, time required for replacement is reduced and man-hour for replacement is reduced.

What is claimed is:

1. An image forming apparatus comprising:

an image transfer unit that transfers a reversal image based on a scanned document image onto an image bearing member as a toner image;

a transfer-unit supporting unit;

a transfer roller that is supported by the transfer-unit supporting unit and comes into contact with the image bearing member and transfers the toner image onto a recording medium;

a transfer-roller housing unit that houses the transfer roller;

a lubricant applying brush that comes into contact with the transfer roller and applies a lubricant to the transfer roller;

a solid lubricant that supplies the lubricant to the lubricant applying brush;

a driving gear that transmits rotational force from the outside to the lubricant applying brush; and a lubricant unit that supports at least the lubricant applying brush, the solid lubricant and the driving gear in an integral state and is formed to be detachably attachable to the transfer-unit supporting unit.

2. The apparatus according to claim 1, further comprising a lubricant applying brush housing unit that houses the lubricant applying brush and the solid lubricant and a lubricant holding member that elastically holds the solid lubricant via a pressing spring.

3. The apparatus according to claim 2, wherein a projection projecting to the lubricant holding member side is provided on a bottom surface of the lubricant-applying-brush housing unit and the pressing spring is attached to the projection.

4. The apparatus according to claim 2, wherein the lubricant holding member is a resin material.

5. The apparatus according to claim 1, wherein the solid lubricant is zinc stearate.

6. The apparatus according to claim 1, wherein the lubricant applying brush is a fur brush.

7. The apparatus according to claim 1, further comprising a contact and separation unit that brings the transfer roller into contact with and separates the transfer roller from the image bearing member.

8. The apparatus according to claim 1, wherein the transfer unit further includes a cleaning blade that scrapes off a toner on the transfer roller to clean the transfer roller.

9. A transfer unit comprising:

a transfer-unit supporting unit;

a transfer roller that is supported by the transfer-unit supporting unit and comes into contact with an image bearing member and transfers a toner image onto a recording medium;

a transfer-roller housing unit that houses the transfer roller;

a lubricant applying brush that comes into contact with the transfer roller and applies a lubricant to the transfer roller;

a solid lubricant that supplies the lubricant to the lubricant applying brush;

a driving gear that transmits rotational force from the outside to the lubricant applying brush; and a lubricant unit that supports at least the lubricant applying brush, the solid lubricant, and the driving gear in an integral state and is formed to be detachably attachable to the transfer-unit supporting unit.

10. The unit according to claim 9, further comprising a lubricant applying brush housing unit that houses the lubricant applying brush and the solid lubricant and a lubricant holding member that elastically holds the solid lubricant via a pressing spring.

11. The unit according to claim 10, wherein a projection projecting to the lubricant holding member side is provided on a bottom surface of the lubricant-applying-brush housing unit and the pressing spring is attached to the projection.

12. The unit according to claim 10, wherein the lubricant holding member is a resin material.

13. The unit according to claim 9, wherein the solid lubricant is zinc stearate.

14. The unit according to claim 9, wherein the transfer unit further includes a cleaning blade that scrapes off a toner on the transfer roller to clean the transfer roller.

15. An image forming method for an image forming apparatus including an image transfer unit that transfers a reversal image based on a scanned document image onto an image bearing member as a toner image, a transfer-unit supporting unit, a transfer roller that is supported by the transfer-unit supporting unit and comes into contact with the image bearing member and transfers the toner image onto a recording medium, a transfer-roller housing unit that houses the transfer roller, a lubricant applying brush that comes into contact with the transfer roller and applies a lubricant to the transfer roller, a solid lubricant that supplies the lubricant to the lubricant applying brush, a driving gear that transmits rotational force from the outside to the lubricant applying brush, and a contact and separation unit that brings the transfer roller into contact with and separates the transfer roller from the image bearing member, wherein at least the lubricant applying brush, the solid lubricant, and the driving gear are supported by a lubricant unit in an integral state and are detachably attached to the transfer-unit supporting unit.

16. The method according to claim 15, wherein a lubricant holding member is elastically attached to a housing unit of the lubricant applying brush via a pressing spring.

17. The method according to claim 16, wherein a projection projecting to the lubricant holding member side is provided on a bottom surface of the housing unit of the lubricant applying brush and the pressing spring is attached to the projection.

18. The method according to claim 16, wherein the lubricant holding member is a resin material.

19. The method according to claim 15, wherein the solid lubricant is zinc stearate.

20. The method according to claim 15, wherein the lubricant applying brush is a fur brush.

* * * * *